US008922320B2

(12) United States Patent
Eom et al.

(10) Patent No.: US 8,922,320 B2
(45) Date of Patent: Dec. 30, 2014

(54) TRANSFORMER

(71) Applicant: LSIS Co., Ltd., Anyang-si, Gyeonggi-do (KR)

(72) Inventors: Jun Seok Eom, Pyeongtaek-si (KR); Woo Sup Kim, Seoul (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/027,039

(22) Filed: Sep. 13, 2013

(65) Prior Publication Data

US 2014/0077916 A1 Mar. 20, 2014

(30) Foreign Application Priority Data

Sep. 14, 2012 (KR) ..... 10-2012-0102458

(51) Int. Cl.

| | |
|---|---|
| ***H01F 27/30*** | (2006.01) |
| ***H01F 27/29*** | (2006.01) |
| ***H01F 27/24*** | (2006.01) |
| ***H01F 27/28*** | (2006.01) |
| ***H01F 27/32*** | (2006.01) |

(52) U.S. Cl.

CPC ..... *H01F 27/2876* (2013.01); *H01F 27/325* (2013.01)

USPC ..... 336/198; 336/208; 336/192; 336/212; 336/232

(58) Field of Classification Search

USPC ..... 336/198, 208, 192, 182, 183, 212, 232, 336/220, 221

See application file for complete search history.

(56) References Cited

U.S. PATENT DOCUMENTS

| | | | | |
|---|---|---|---|---|
| 3,750,073 | A * | 7/1973 | Okano | 336/198 |
| 5,010,314 | A * | 4/1991 | Estrov | 336/198 |
| 6,630,880 | B2 * | 10/2003 | Cheung et al. | 336/198 |
| 2003/0098769 | A1 | 5/2003 | Cheung et al. | |
| 2004/0257190 | A1 * | 12/2004 | Peck et al. | 336/212 |
| 2006/0044102 | A1 | 3/2006 | Tsergas et al. | |
| 2012/0154089 | A1 | 6/2012 | Eom et al. | |
| 2012/0154095 | A1 | 6/2012 | Li et al. | |
| 2012/0320505 | A1 * | 12/2012 | Lee et al. | 361/679.01 |

FOREIGN PATENT DOCUMENTS

| | | |
|---|---|---|
| EP | 1722381 | 11/2006 |
| JP | 08-316059 | 11/1996 |
| JP | 2002-208524 | 7/2002 |
| JP | 2003017334 | 1/2003 |
| JP | 2009296017 | 12/2009 |
| JP | 2010-056101 | 3/2010 |
| JP | 2012-038941 | 2/2012 |

OTHER PUBLICATIONS

Korean Intellectual Property Office Application Serial No. 10-2012-0102458, Office Action dated Oct. 15, 2013, 4 pages.

Korean Intellectual Property Office Application Serial No. 10-2012-0102458, Notice of Allowance dated Mar. 3, 2014, 2 pages.

Japan Patent Office Application Serial No. 2013-190878, Office Action dated Mar. 24, 2014, 5 pages.

Japan Patent Office Application Serial No. 2013-190878, Office Action dated Jul. 24, 2014, 2 pages.

European Patent Office Application Serial No. 13183678.5, Search Report dated Sep. 12, 2014, 6 pages.

* cited by examiner

*Primary Examiner* — Mangtin Lian

(74) *Attorney, Agent, or Firm* — Lee, Hong, Degerman, Kang & Waimey

(57) ABSTRACT

The embodiment relates to a transformer. A transformer according to an aspect includes: a first coil assembly including a first core, a first bobbin coupled to the first core, and a first coil provided on the first bobbin; and a second coil assembly coupled to the first coil assembly, and including a second core, a second bobbin coupled to the second core, and a second coil provided on the second bobbin.

15 Claims, 6 Drawing Sheets

TRANSFORMER

CROSS-REFERENCE TO RELATED APPLICATIONS

Pursuant to 35 U.S.C. §119(a), this application claims the benefit of earlier date and right of priority to Korean Patent Application No. 10-2012-0102458, filed on Sep. 14, 2012, the contents of which is incorporated by reference herein in its entirety.

BACKGROUND

The present disclosure relates to a transformer.

In general, a transformer is a device for changing AC voltage or current by using an electromagnetic induction phenomenon.

The transformer may include a bobbin for winding a primary coil and a secondary coil, and a plurality of cores coupled with the bobbin.

Since a work of winding the primary coil and the secondary coil on the bobbin is required in order to manufacture such a conventional transformer, a working hours increases and the work becomes complicated.

Further, the transformer using the primary coil and the secondary coil may be generally used when low current is applied because heat emission increases, but heat dissipation is difficult when high current is applied.

SUMMARY

Embodiments relate to a transformer.

In one embodiment, a transformer includes: a first coil assembly including a first core, a first bobbin coupled to the first core, and a first coil provided on the first bobbin; and a second coil assembly coupled to the first coil assembly, and including a second core, a second bobbin coupled to the second core, and a second coil provided on the second bobbin.

In another embodiment, a transformer includes: a first core, a first bobbin seated on the first core, a first plate type coil seated on the first bobbin, an intermediate plate seated on the first plate type coil, a second plate type coil seated on the intermediate plate, a second bobbin seated on the second plate type coil, and a second core seated on the second bobbin.

In still another embodiment, a transformer includes a first core, a first bobbin seated on the first core, a first coil connected to the first bobbin, a second coil spaced apart from the first coil, a second bobbin connected to the second coil, and a second core seated on the second bobbin, and a cutout portion for locating at least one of the first coil and the second coil is formed in at least one of the first bobbin and the second bobbin.

The details of one or more embodiments are set forth in the accompanying drawings and the description below. Other features will be apparent from the description and drawings, and from the claims.

DETAILED DESCRIPTION OF THE EMBODIMENTS

Figure 1:
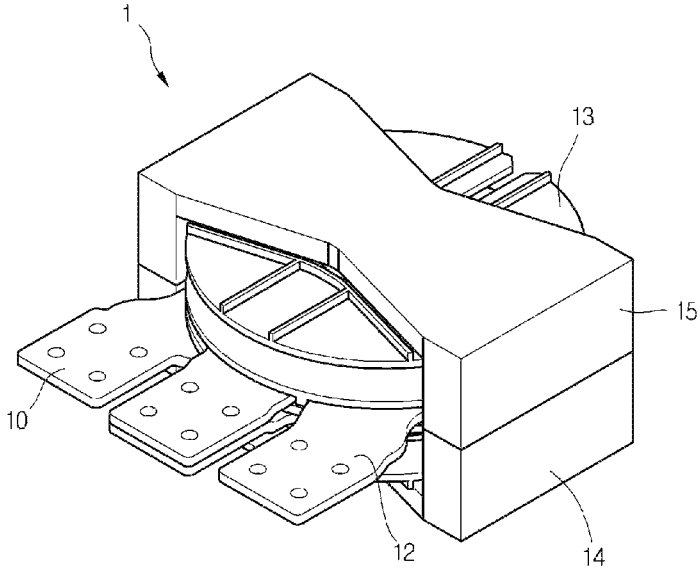
FIG. 1 is a perspective view of a transformer according to an embodiment.

Hereinafter, some embodiments of the present invention will be described in detail with reference to the accompanying drawings in the present invention. When reference numerals refer to components of each drawing, it is noted that although the same components are illustrated in different drawings, the same components are referred to by the same reference numerals as possible. In describing the embodiments of the present invention, when it is determined that the detailed description of the known art related to the present invention may obscure the gist of the present invention, the detailed description thereof will be omitted.

Further, in describing components of the embodiment of the present invention, terms such as first, second, A, B, (a), (b), and the like may be used. The terms are used to just distinguish the components from other components and properties, or a sequence or an order of the corresponding components is not limited by the terms. When it is disclosed that any component is "connected", "coupled", or "linked" to other components, it should be understood that the component may be directly connected or linked to other components, but another component may be "connected", "coupled", or "linked" between the respective components.

Figure 2:
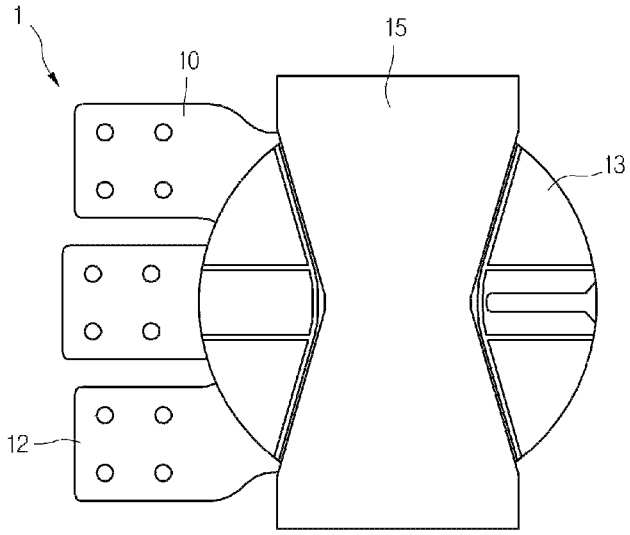
FIG. 2 is a plan view of the transformer according to the embodiment.
Figure 3:
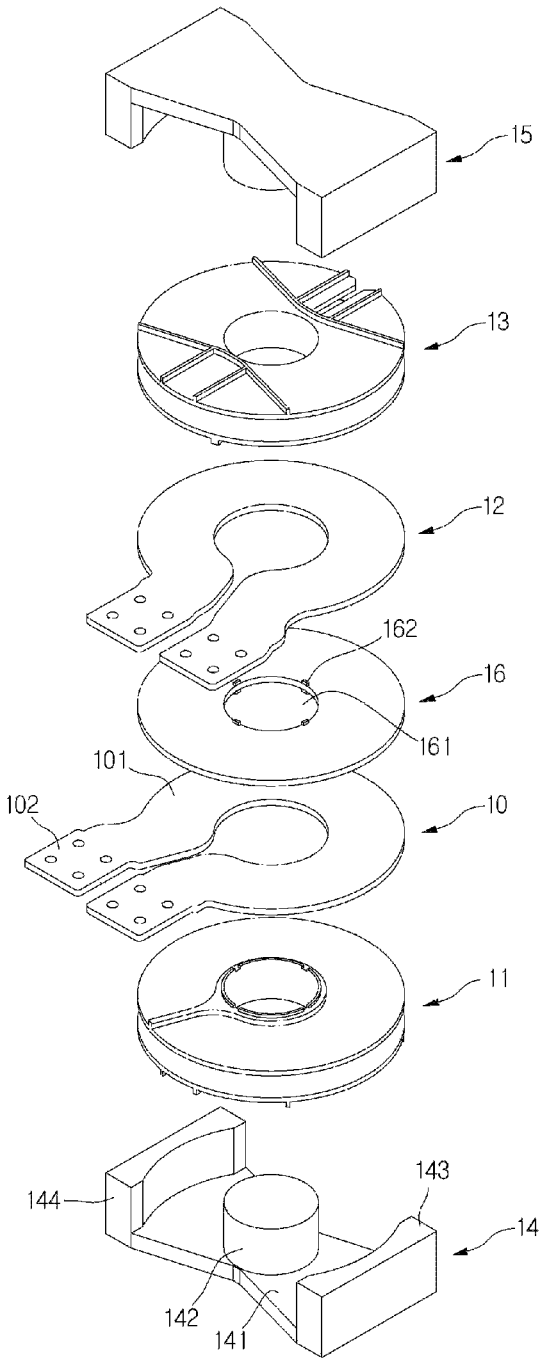
FIG. 3 is an exploded perspective view of the transformer according to the embodiment.

FIG. 1 is a perspective view of a transformer according to an embodiment. FIG. 2 is a plan view of the transformer according to the embodiment. FIG. 3 is an exploded perspective view of the transformer according to the embodiment.

Referring to FIGS. 1 to 3, a transformer 1 according to an embodiment may include bobbins 11 and 13, coils 10 and 12, and cores 14 and 15.

In detail, the coils 10 and 12 may include a first plate type coil 10 and a second plate type coil 12. Each of the plate type coils 10 and 12 may include a coil part 101 and a plurality of terminal parts 102 provided at both ends of the coil part 101.

The coil part 101 may have a shape such as "U" or "C" as one example, but the shape of the coil part 101 is not limited thereto. One or more holes for connecting other electric components may be formed at one or more of the plurality of terminal parts 102.

At least a part of any one of the terminal parts of the first plate type coil 10 may overlap with any one of the terminal parts of the second plate type coil 12 in a vertical direction (a direction in which the first plate type coil and the second plate type coil are arranged). On the contrary, the other one of the terminal parts s of the first plate type coil 10 and the other one of the terminal parts of the second plate type coil 12 may nonoverlap with each other in the vertical direction (the direction in which the first plate type coil and the second plate type coil are arranged).

The bobbins 11 and 13 may include a lower bobbin 11 (alternatively, a first bobbin) and an upper bobbin 13 (alternatively, a second bobbin).

The lower bobbin 11 and the upper bobbin 13 have the same shape and may be disposed to be symmetric to each other. Of course, the lower bobbin 11 and the upper bobbin 13 may have different shapes.

The first plate type coil 10 may be seated on the lower bobbin 11. The upper bobbin 13 may be seated on the second plate type coil 12. That is, each of the bobbins 11 and 13 serves to fix the location of each of the plate type coils 10 and 12.

In this case, the first plate type coil 10 may be a primary coil and the second plate type coil 12 may be a secondary coil. As another example, the first plate type coil 10 may be the secondary coil and the second plate type coil 12 may be the primary coil.

An intermediate plate 16 may be provided between the first plate type coil 10 and the second plate type coil 12. The intermediate plate 16 is connected to the lower bobbin 11 and the upper bobbin 13 to fix relative locations of the lower bobbin 11 and the upper bobbin 13. Moreover, the intermediate plate 16 enables electrically insulating the first plate type coil 10 and the second plate type coil 12 from each other. That is, the intermediate plate 16 separates the first plate type coil 10 and the second plate type coil 12 from each other.

An opening portion 161 may be formed at the center of the intermediate plate 16 and a plurality of coupling portions 162 for coupling with each of the bobbins 11 and 13 may be formed at a location adjacent to the opening portion 161. That is, one or more coupling portions 162 may be projected onto the top and the bottom of the intermediate plate 16, respectively.

The coupling portion 162 may be inserted into the bobbins 11 and 13 as one example. When the coupling portion 162 is inserted into the bobbins 11 and 13, the intermediate plate 16 may be prevented from being rotated between the first plate type coil 10 and the second plate type coil 12. As another example, coupling grooves are formed on the top and the bottom of the intermediate plate 16, respectively and the coupling portion inserted into the coupling groove may be formed in each of the bobbins 11 and 13.

The cores 14 and 15 may include a lower core 14 (alternatively, a first core) and an upper core 15 (alternatively, a second core). The lower core 14 and the upper core 15 may have the same shape. Therefore, hereinafter, only a structure of the lower core 14 will be described and it will be disclosed that the description of the lower core is similarly applied to even the upper core 15.

The lower core 14 may include a seating portion on which the lower bobbin 11 is seated, an insertion portion inserted into the lower bobbin 11 which is seated on the seating portion 141, and a plurality of side covers 143 and 144 projected on both sides of the seating portion 141 and covering both sides of the lower bobbin 11 seated on the seating portion 141.

The insertion portion 142 may have, for example, a cylindrical shape in order to be easily inserted into the lower bobbin 11, but may have a shape different therefrom.

The side cover 143 may have a round surface having the same curvature as a circumferential surface of the lower bobbin 11. The side cover 143 may contact the lower bobbin 11 or be spaced apart from the lower bobbin 11 by a predetermined gap.

Figure 4:
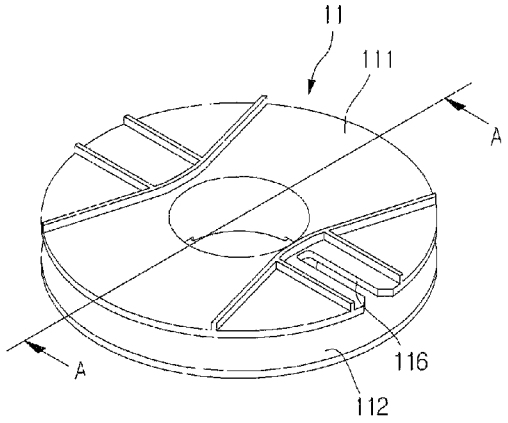
FIG. 4 is a lower perspective view of the lower bobbin according to the embodiment of the present invention.
Figure 5:
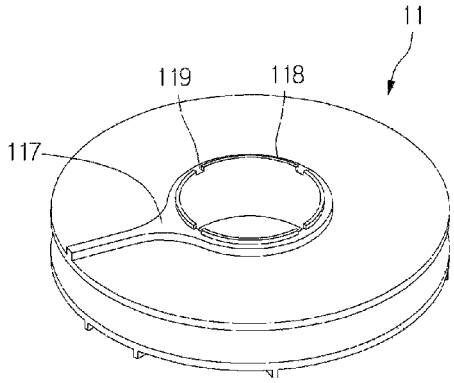
FIG. 5 is an upper perspective view of the lower bobbin according to the embodiment of the present invention.
Figure 6:
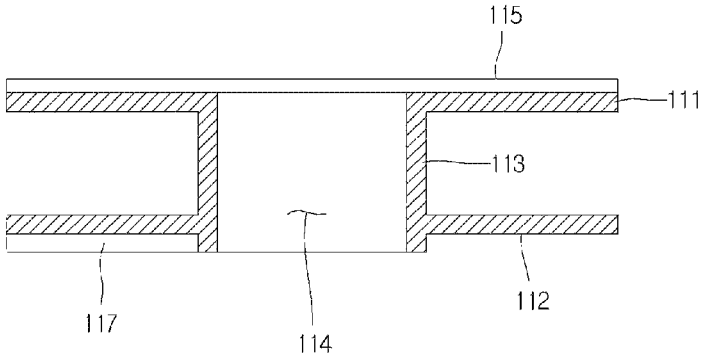
FIG. 6 is a cross-sectional view taken along line A-A of FIG. 4.

FIG. 4 is a lower perspective view of the lower bobbin according to the embodiment of the present invention. FIG. 5 is an upper perspective view of the lower bobbin according to the embodiment of the present invention. FIG. 6 is a cross-sectional view taken along line A-A of FIG. 4.

Hereinafter, a structure of the lower bobbin will be described and it will be disclosed that the description of the lower bobbin may be just applied to even the upper bobbin. However, since the upper bobbin and the lower bobbin are disposed to be line-symmetric or point-symmetric to each other, each component of the lower bobbin may be disposed in opposition to that of the upper bobbin.

Referring to FIGS. 4 to 6, the lower bobbin 11 may include a first plate 111 seated on the lower core 14, a second plate 112 spaced apart from the first plate 111, on which the first plate type coil 10 is seated, and a connection portion 113 connecting the first plate 111 and the second plate 112.

The first plate 111 and the second plate 112 may have a disk shape as one example. In addition, a hole (reference numeral is not displayed) to be inserted with the insertion portion 142 of the lower core 14 may be formed at the centers of the first plate 111 and the second plate 112.

The connection portion 113 may have a cylindrical shape having a hollow 114 as one example. Therefore, the insertion portion 142 of the lower core 14 may penetrate the hole of each plate 111 or 112 and the hollow 114. The first plate 111, the second plate 112, and the connection portion 113 may be integrally formed or separately formed to be coupled to each other.

The transformer 1 of the embodiment may adopt the plate type coils 10 and 12 or may adopt a wire-shaped coil without using the plate type coils 10 and 12. When the wire shaped coil is adopted, the wire-shaped coil may be wound on the connection portion 113 and as the connection portion 113 has the cylindrical shape, the wire-shaped coil may be easily wound on the connection portion 113. That is, the wire-shaped coil may be wound on the connection portion of the lower bobbin and the wire-shaped coil may be wound on the connection portion of the upper bobbin.

In the embodiment, the coil wound on the lower bobbin 11 may be the primary coil or the secondary coil. In the embodiment, the coil wound on the lower bobbin 13 may be the primary coil or the secondary coil.

Therefore, in the specification, a coil which may be seated or wound on the lower bobbin will be referred to as a first coil and a coil which may be seated or wound on the upper bobbin will be referred to as a second coil. That is, the lower bobbin serves to support the first coil and the upper bobbin serves to support the second coil.

A plurality of antirotation ribs 115 for preventing rotation of the lower bobbin 11 while the plurality of antirotation ribs 115 is seated on the lower core 14 may be formed on the first plate 111. The plurality of antirotation ribs 115 is disposed to be spaced apart from each other and a separation distance is the same as a width of the seating portion 141 of the lower core 14. In addition, a horizontal cross-section of the seating portion 141 of the lower core has a non-circular shape.

Therefore, when the first plate 111 is seated on the seating portion 141 of the lower core 14, the plurality of antirotation ribs 115 contacts both sides of the seating portion 141 of the lower core 14 to prevent rotation of the lower bobbin 11. That is, the seating portion of the lower core 14 is positioned between the plurality of antirotation ribs 115.

A cutout portion 116 for locating the wire-shaped coil may be formed on the first plate 111 so as to fix and connect the wire-shaped coil when the wire-shaped coil is wound on the lower bobbin 111.

The second plate 112 may include a guide portion 117 guiding a seating location of the first plate type coil 10. The guide portion 117 may prevent rotation of the first plate type coil 10.

A plurality of ribs 118 for forming an insertion groove 119 inserted with the coupling portion 162 of the intermediate plate 16 may be formed in the guide portion 117.

At least a part of the guide portion 117 may extend in a radial direction at the center of the second plate 112.

The plurality of ribs 118 is disposed to be separated from each other and the insertion groove 119 may be formed between the plurality of ribs 118. As another example, the insertion groove 119 may be formed at the rib 118.

Alternatively, the rib 118 is not formed in the guide portion 117 but may be projected directly on the second plate 112 at a location separated from the guide portion 117.

Hereinafter, a method of assembling the transformer of the present invention will be described.

In the specification, the lower core, the lower bobbin, and the first plate type coil will be referred to as a first coil assembly and the upper core, the lower bobbin, and the second plate type coil will be referred to as a second coil assembly.

First, the first coil assembly and the second coil assembly are completed.

In order to complete the first coil assembly, the first plate type coil 10 is seated on the second plate 112 of the lower bobbin 11. In addition, the lower bobbin 11 is seated on (coupled to) the lower core 14.

In order to complete the second coil assembly, the second plate type coil 12 is seated on the second plate of the lower bobbin 13. In addition, the upper bobbin 13 is seated on (coupled to) the upper core 15.

Next, the first coil assembly and the second coil assembly are coupled to each other while the intermediate plate 16 is positioned between the first coil assembly and the second coil assembly.

In this case, the first coil assembly and the second coil assembly may be coupled to each other by coupling the upper core and the lower core with a fastening means as one example.

In the present invention, a manufacturing sequence of the transformer is not limited to the aforementioned sequence and the lower core to the upper core may be sequentially assembled or assembled in an opposite sequence thereto.

According to the proposed invention, since excellent heat emission performance may be maintained even when high current is applied in the case where a plate type coil is used as a type of the coil, the transformer may be stably operated.

Further, as the guide portion for guiding the seating location of the plate type coil is provided in the bobbin, misassembly of the plate type coil is prevented.

In addition, a structure in which the plate type coil may be seated on the bobbin is formed and a structure in which the wire-shaped coil may be wound is provided, and as a result, various types of transformers may be manufactured without changing the structure.

In the present invention, it has been described that the plate coil or the wire-shaped coil is used as the primary coil and the secondary coil in the transformer, but contrary to this, any one of the primary coil and the secondary coil is used as the plate type coil and the other one may be used as the wire-shaped coil. However, when any one is the wire-shaped coil, the intermediate plate may be omitted.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A transformer, comprising:

a first coil assembly including a first core, a first bobbin coupled to the first core, and a first coil provided on the first bobbin; and a second coil assembly coupled to the first coil assembly, and including a second core, a second bobbin coupled to the second core, and a second coil provided on the second bobbin, wherein at least one of the first bobbin or the second bobbin comprises a guide portion guiding a seating location of at least one of the first coil or the second coil and preventing rotation of the at least one of the first coil or the second coil, wherein the at least one of the first coil or the second coil is a plate type coil having a first portion provided with a first terminal and a second portion provided with a second terminal, and the first portion and the second portion are spaced apart from each other, and wherein the guide portion is positioned between the first portion and the second portion in at least the first or second coil assembly.

2. The transformer of claim 1, wherein each of the first bobbin and the second bobbin includes a first plate seated on each core, a second plate spaced apart from the first plate, and a connection portion for connecting the first plate and the second plate.

3. The transformer of claim 2, wherein the plate type coil is seated on the second plate.

4. The transformer of claim 3, wherein the second plate is provided with the guide portion.

5. The transformer of claim 3, further comprising an intermediate plate disposed between the first bobbin and the second bobbin.

6. The transformer of claim 5, wherein the intermediate plate is disposed between the first coil and the second coil, and any one of the intermediate plate and each bobbin includes one or more coupling portions, and the other one of the intermediate plate and the each bobbin includes one or more insertion grooves to which the one or more coupling portions are inserted.

7. The transformer of claim 3, wherein the first coil and the second coil are the plate type coil, each of the first coil and the second coil includes a plurality of terminal parts, and any one terminal part of the plurality of terminals of the first coil overlaps with any one terminal part of the plurality of terminal parts of the second coil in a direction in which the first plate type coil and the second plate type coil are arranged.

8. The transformer of claim 2, wherein the first plate includes one or more anti-rotation ribs for preventing rotation with being seated on the core.

9. The transformer of claim 1, wherein at least a part of the guide portion extends in a radial direction at a center of the at least one of the first bobbin or the second bobbin.

10. A transformer, comprising:

a first core;

a first bobbin seated on the first core;

a first plate type coil seated on the first bobbin;

an intermediate plate seated on the first plate type coil;

a second plate type coil seated on the intermediate plate;

a second bobbin seated on the second plate type coil; and a second core seated on the second bobbin, wherein the intermediate plate is disposed between the first bobbin and the second bobbin, wherein one of the intermediate plate and each bobbin includes one or more coupling portions, and the other one of the intermediate plate and each bobbin includes one or more insertion grooves to which the one or more coupling portions are inserted.

11. The transformer of claim 10, wherein the first core includes an insertion portion for penetrating the first bobbin, and the second core includes an insertion portion for penetrating the second bobbin.

12. The transformer of claim 10, wherein each bobbin is provided with a guide portion guiding a seating location of the first or second plate type coil and preventing rotation of the seated first or second plate type coil.

13. The transformer of claim 10, wherein any one of the intermediate plate and each bobbin includes one or more coupling portions, and the other one of the intermediate plate and the each bobbin includes one or more insertion grooves to which the one or more coupling portions are inserted.

14. The transformer of claim 10, wherein each bobbin is provided with one or more anti-rotation ribs for preventing rotation with being seated on the first or second core.

15. The transformer of claim 10, wherein each of the first plate type coil and the second plate type coil includes a plurality of terminal parts, and wherein any one terminal part of the plurality of terminal parts of the first plate type coil overlaps with any one terminal part of the plurality of terminal parts of the second plate type coil in a direction in which the first plate type coil and the second plate type coil are arranged.

* * * * *